United States Patent [19]

Gauthier

[11] 4,449,251

[45] May 22, 1984

[54] NECK AND COLLARBONE PROTECTOR

[76] Inventor: Jean-Marc Gauthier, 84 Linwell Rd., St. Catharines, Ontario, Canada, L2N 6B1

[21] Appl. No.: 347,813

[22] Filed: Feb. 11, 1982

Related U.S. Application Data

[63] Continuation-in-part of Ser. No. 239,285, Mar. 2, 1981, abandoned.

[51] Int. Cl.[3] ..... A41D 13/00

[52] U.S. Cl. ..... 2/2

[58] Field of Search ..... 2/2, 2.5, 129; 128/380, 128/75, DIG. 15, DIG. 23

[56] References Cited

U.S. PATENT DOCUMENTS

| | | | |
|---|---|---|---|
| 1,648,970 | 11/1927 | Strelow | 128/DIG. 23 |
| 3,514,784 | 6/1970 | McDavid | 2/2 |
| 3,855,631 | 12/1974 | Ettinger | 2/2 |
| 4,232,663 | 11/1980 | Newton | 128/DIG. 23 |
| 4,324,003 | 4/1982 | Johnston | 2/2 |

*Primary Examiner*—Louis Rimrodt

*Attorney, Agent, or Firm*—Hirons, Rogers & Scott

[57] ABSTRACT

A lightweight sports neck and collarbone protector is provided for sports players, especially for lacrosse or hockey players, comprising a combined bib and upstanding collar to protect the clavicles and throat of the wearer respectively, the bib and collar being connected together along the entire length of their junction so that the collar holds the bib in position and an object such as a hockey stick or skate blade cannot pass between them. Each of the bib and collar includes protective padding and armour members to overlie the clavicles and vulnerable front and side parts of the throat. The padding may be foam padding and the armour members may be stiff plastics sheet material, the padding preferably being moulded from a soft plastics material as an integral member, while the armour members are moulded from a more rigid plastics mateiral, also as an integral unit with a thin flexible connection between the armour members. The padding and armour members may be adhered, stitched or otherwise fixed together against dislocation from an optimum position.

13 Claims, 3 Drawing Figures

NECK AND COLLARBONE PROTECTOR

CROSS-REFERENCE TO RELATED APPLICATIONS

This application is a continuation-in-part of my application Ser. No. 239,285, filed Mar. 2, 1981, now abandoned.

FIELD OF THE INVENTION

The invention relates to protective wear, particularly for certain sports players, and particularly to protect the throat and the clavicles (collarbones) of such players.

BACKGROUND OF THE INVENTION

In the playing of some sports, for example ice hockey and lacrosse, a great deal of protective padding is worn by the players, such as gloves, elbow pads and shin pads. The collarbone and throat regions are particular parts of the player's body which are vulnerable to blows and to cuts, and broken collarbones and cuts to the throat are common. With the known protective wear it has not been found possible to provide adequate protection for these parts of the body, while allowing the player sufficient mobility to play the game.

Some protective shields are available for players where mobility is not so important, such as the goaltender. Various mobility-reducing braces and strapping have been proposed for supporting the collarbone during healing, once damaged.

SUMMARY OF THE INVENTION

An object of the present invention is the provision of protective wear for sports players to protect the clavicle and throat regions.

According to the present invention there is provided a lightweight neck and clavicles protector for sports players comprising:

a bib including a clavicle covering part comprising a layer of protective padding and at least one clavicle armour member mounted on the protective padding layer whereby with the protector in position on the wearer the clavicle armour member is positioned above the clavicles; and a collar comprising a layer of protective padding and at least one throat armour member mounted on the protective padding whereby with the protector in position on the wearer the throat armour member is positioned over the throat;

the bib being attached to the collar along its entire junction with the collar and the collar being provided with means for fastening it about the neck of the wearer, so that the collar holds the bib in place over the chest of the wearer and an object cannot pass between the collar and the bib.

DESCRIPTION OF THE DRAWINGS

Particular preferred embodiments of the invention will now be described, by way of example, with reference to the accompanying drawings in which.

DESCRIPTION OF THE PREFERRED EMBODIMENTS

Figure 1:
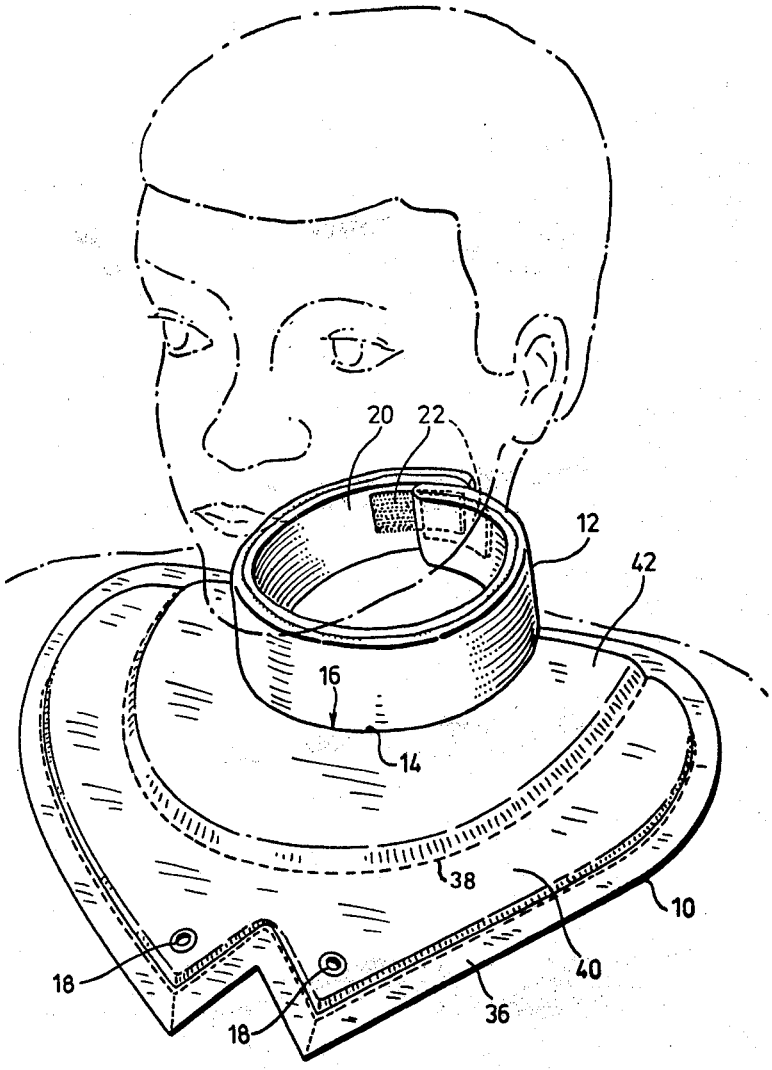
FIG. 1 is a perspective view of a combined bib and collar which is a first embodiment of the invention.

A protector comprises a bib 10 shaped to overlie the top and neck region of a wearer's chest from mid-shoulder to sternum so that at least both the clavicles will be covered. The lower part of the bib is provided with means for attachment to other clothing worn by the player, and such means are eyelets 18 through the thickness of the bib and through which laces may be passed for attachment to the body padding used, for example, by ice hockey or lacrosse players.

The protector also comprises a collar 12 upstanding from the bib 10 to an extent sufficient at least to cover the larynx at the front of the throat of the wearer, and should also extend far enough around the throat on both sides to protect the carotid artery and the jugular vein. The collar 12 is connected to the bib 10 through a neck edge 14 of the bib and one elongate edge 16 of the collar and extends at each end 20 beyond the neck edge 14 so as to completely encircle the throat of the wearer. The ends 20 of collar 12 are equal in length and of sufficient length to meet an overlap; they are provided with hook and loop fastenings 22, for example of Velcro (Trade Mark) fastening material, which releasably holds the ends 20 together around the neck of a wearer.

The collar need not extend beyond the neck edge 14 of the bib provided that other fastening means, for example tapes, are provided to fasten it around the neck of a wearer. Complete encirclement is preferred because of the additional protection provided. In another arrangement only one end of the collar 12 extends beyond the neck edge 14 of the bib 10, this end being of sufficient length to pass around the back portion of the neck of a wearer and fasten at the front. The two ends of the collar need not be of equal lengths.

The bib 10 is made up of an under-layer 24 of sheet material, which may suitably be soft pleasant-handling textile material, to overlie a wearer's chest. Over the layer 24 lies a similarly shaped sheet 26 of protective padding which in this embodiment is foamed plastic material. Located over sheet 26 are two foam padding or other lower padding members 28. Each member 28 is a flattened pad of such size and shape to conform roughly to the outline of the clavicle. Each member 28 is located on sheet 26 so that when the collar is fastened around the neck of a wearer, it covers the outline of the wearer's clavicle.

The bib is also provided with a clavicle armour member constituted by two armour member portions placed on top of a respective padding member 28. Each armour member portion 30 is formed from stiff sheet material and conforms to the shape of the padding member 28 which it covers. The preferred material for the armour member portions 30 is plastics sheet material which is stiff with respect to the protective padding. However, the armour member might be stamped from metal sheet. These bib armour member portions may be slightly dished in both length and width so as to conform better to the contours of the body of the wearer.

The upper foam or other padding member 32 overlies the armour member portions 30 and the under padding members 28. Outer padding member 32 generally follows the outlines of the previously described padding members 28 and armour member portions 30 but is formed as a single piece of semi-annular shape.

The layers constituted by padding layer 26, padding member 28, armour member portions 30 and outer padding member 32 are held in their positions with respect to one another by any convenient means, for example, by stitching or adhering them together. An outermost layer 34 of sheet material, which may be textile material, is applied over the outer padding member 32. The layer 34 is similar to layer 24 and these two layers 24, 34 sandwich the padding 26, 28 and 32 and armour members 30 between them. The edges of at least under layer 24, outer layer 34 and padding sheet 26 are secured together by stitching, an edge binding tape 36 being provided. Stitching 38 is provided through at least under layer 24, outer layer 34 and padding sheet 28, so as to divide the bib into a lower compartment 40 and an upper compartment 42, the latter confining the members 28, 32 and armour member portions 30 and thus providing an insurance against any dislocation of those members from their locations.

The upstanding collar 12 comprises an under layer 44 which lies against the skin of the throat and an outer layer 46, both of which may be of textile material. Sandwiched between the under and outer layers 44 and 46 is a layer 48 or protective padding extending over the available area. Between the padding 48 and the outer collar layer 46 is a throat armour member which in this embodiment is constituted by three separate, spaced throat armour member portions 50. The central throat armour member portion 50 is located to protect the front of the throat of the wearer, in particular the windpipe, while the two adjacent throat armour member portions 50 are located to protect the sides of the throat of the wearer, in particular the jugular vein and carotid artery. The member portions 50 are formed from similar materials and in similar manner to armour members 30 and may be adhered, stitched or otherwise fixed to the adjacent padding layer 48 and the enclosing textile material layers 44 and 46.

The lower edge 16 of collar 12 is stitched to neck edge 14 of bib 10 to form a unitary structure in which the collar holds the bib in place on the chest of the wearer, but the bib and the collar can flex relative to one another as necessary to accommodate the head movements of the wearer, in particular any nodding movements. Also because of the unitary connection of the bib with the collar a sharp-edged object, such as a hockey stick blade, or a skate blade, cannot pass between the bib and the collar to injure the wearer. Advantageously the under layers 24 and 44 are of an absorbent textile material to absorb sweat and be non-irritant to the wearer's skin.

Figure 2:
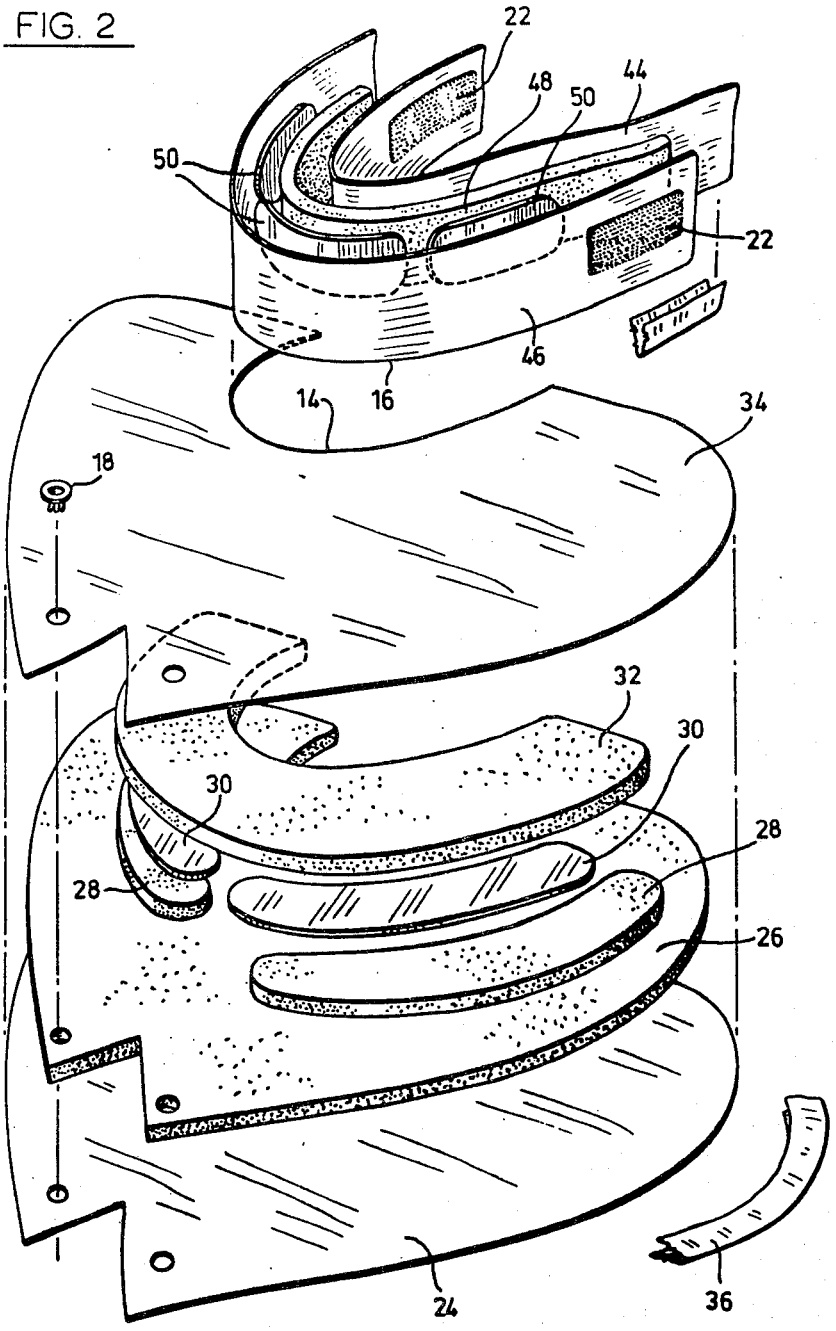
FIG. 2 is an exploded view of the combination of FIG. 1.
Figure 3:
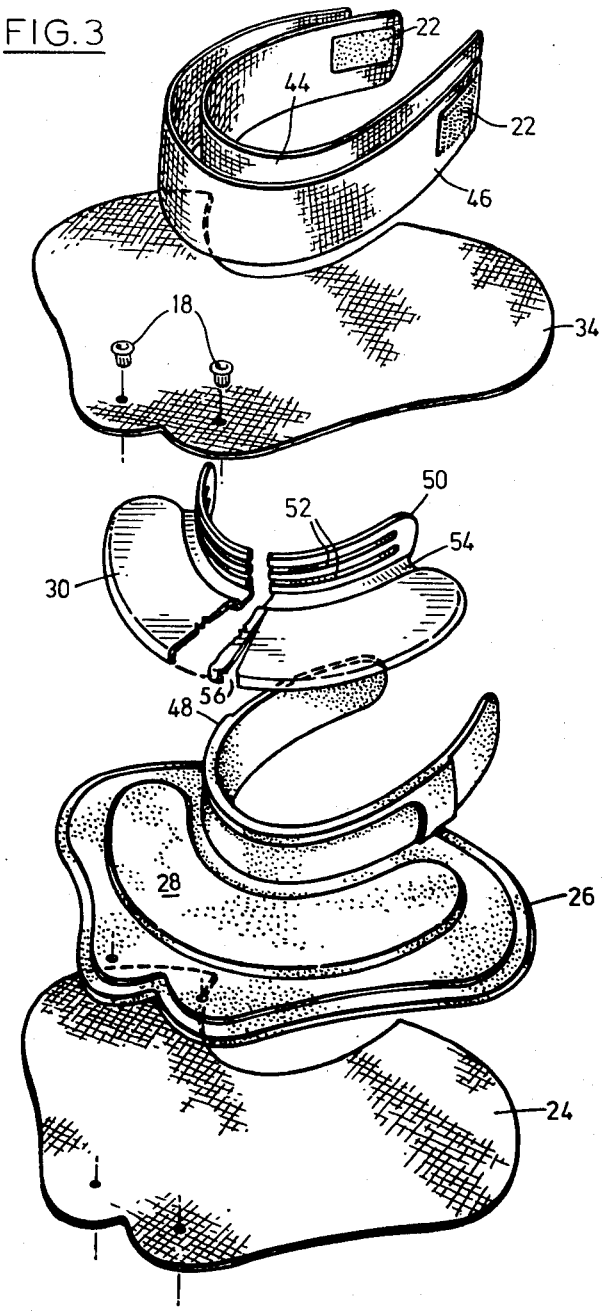
FIG. 3 is an exploded view of a second embodiment.

In FIG. 3 the same reference number is used for similar parts as in FIGS. 1 and 2.

In this embodiment the two armour members 30 and 50 are formed as an integral unit moulded from a suitably rigid plastics material, the members being joined by a connecting portion 54 of much thinner material that will permit the necessary flexing. Moreover, the collar armour member 52 is provided with horizontal slots 52 giving the necessary verticle flexing to accommodate the nodding movements of the wearer's head without discomfort.

The bib armour member 30 also preferably is provided with a notch 56 or other line of weakness dividing the member into two separate portions that extend over the respective collar bones, so that the armour member can flex with shoulder movements of the wearer, and also if the protector is folded to place it in a bag for storage with other equipment of the wearer.

The bib and collar protective padding are also formed by moulding as a single integral unit to which the integral armour members 30 and 50 are fastened. In a preferred process of manufacture the unitary armour members are placed in a suitable mould and the protective padding is then moulded in situ while adhered at the same time to the armour members.

The layers of textile material 24, 34, 44 and 46 are sewn together (as in glove manufacture) inside-out to form a pocket. The pocket is then turned right-side-out, the moulded armour members and protective padding inserted through the opening, which is then sewn shut. It will be apparent that such a construction provides a particularly convenient and simple manufacturing process.

Although the two embodiments described have the padding and armour members enclosed by an envelope of textile material, which is preferred both for appearance and hygenic reasons, the unitary padding member and the unitary armour member can be used alone with suitable means for fastening around the wearer's neck.

A suitable material for the paddng members is polypropylene foam varing in thickness from about 9.5 mm to 12.7 mm at its thickest point beneath the armour members, while a suitable material for the amour members is high density polyethylene of about 1.5–2 mm thickness, the joint 54 being about 0.4 mm thickness.

The resulting protector has been found to be convenient and relatively comfortable to wear while providing desirable protection, especially for young players, against broken collarbones and potentially dangerous blows to the throat from playing sticks, balls or pucks.

I claim:

1. A lightweight neck and clavicles protector for sports comprising:

a bib including a clavicle covering part comprising a layer of protective padding and at least one clavicle armour member mounted on the protective padding layer whereby with the protector in position on the wearer the clavicle armour member is positioned above the clavicles; and a collar comprising a layer of protective padding and at least one throat armour member mounted on the protective padding whereby with the protector in position on the wearer the throat armour member is positioned over the throat;

the bib being attached to the collar along its entire length and the collar being provided with means for fastening it about the neck of the wearer, so that the collar holds the bib in place over the chest of the wearer and an object cannot pass between the collar and the bib.

2. A protector as claimed in claim 1, in which the clavicle covering part of the bib comprises two separate clavicle armour member portions, each adapted to cover a respective clavicle.

3. A protector as claimed in claim 2, wherein the two separate portions of the clavicle armour member are provided by a central notch in the member.

4. A protector as claimed in claim 1, in which the clavicle armour member lies between two layers of protective padding.

5. A protector as claimed in claim 1, in which three separate throat armour member portions are provided to cover the front and the two side throat portions of a wearer.

6. A protector as claimed in any one of claims 1 to 3, wherein the clavicle armour member and the throat armour member are parts of a unitary structure, the two armour members being connected together by a thinner portion of the structure permitting flexing between the two armour members.

7. A protector member as claimed in any one of claims 1 to 3, wherein the bib protective padding and the collar protective padding are parts of a unitary structure.

8. A protector as claimed in any one of claims 1 to 3, and wherein the clavicle armour member and the throat armour member are parts of a moulded plastic unitary structure, the two armour members being connected together by a thinner portion of the structure permitting flexing between the two armour members, and wherein the bib protective padding and the collar protective padding are also parts of a moulded unitary plastic structure, the two structures being connected together.

9. The protector as claimed in any one of claims 1 to 3, wherein the throat armour member is provided with horizontal slots to permit flexing of the member with nodding movements of the wearer's head.

10. A protector as claimed in any one of claims 1 to 3, in which the collar is adapted to extend completely around the neck of the wearer and is provided with cooperating fastenings at its ends for fastening the collar.

11. A protector as claimed in any one of claims 1 to 3, in which a lower portion of the bib is provided with means for attachment to other apparel.

12. A protector as claimed in any one of claims 1 to 3, in which a lower portion of the bib is provided with eyelets comprising means for attachment to other apparel.

13. A protector as claimed in any one of claims 1 to 3, wherein the bib and the collar are enclosed in an external envelope consisting of layers of textile sheet material.

* * * * *